US006460742B1

(12) United States Patent
Fuenders et al.

(10) Patent No.: US 6,460,742 B1
(45) Date of Patent: Oct. 8, 2002

(54) PROCESS FOR REDUCING FUME EMISSIONS DURING MOLTEN METAL TRANSFER

(75) Inventors: Dieter Fuenders, Duisburg; Harald Winter, Moenchengladbach, both of (DE)

(73) Assignee: L'Air Liquide Societe Anonyme pour l'etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/013,096

(22) Filed: Jan. 26, 1998

Related U.S. Application Data

(63) Continuation of application No. 08/746,310, filed on Nov. 8, 1996, now abandoned, which is a continuation-in-part of application No. 08/474,194, filed on Jun. 7, 1995, now Pat. No. 6,045,805, which is a continuation of application No. 08/310,359, filed on Sep. 21, 1994, now abandoned, which is a continuation of application No. 08/187,660, filed on Jan. 25, 1994, now abandoned, which is a continuation of application No. 07/815,578, filed on Dec. 30, 1991, now abandoned, which is a continuation of application No. 07/477,581, filed on Feb. 9, 1990, now abandoned.

(30) Foreign Application Priority Data

Feb. 14, 1989 (DE) ..... 39 04 415

(51) Int. Cl.[7] ..... B22D 37/00

(52) U.S. Cl. ..... 222/590; 266/44; 266/78; 266/147

(58) Field of Search ..... 266/44, 45, 147, 266/207, 78, 94, 99, 96; 222/590

(56) References Cited

U.S. PATENT DOCUMENTS

| | | | | |
|---|---|---|---|---|
| 4,723,997 A | | 2/1988 | Lutgen | |
| 4,781,122 A | * | 11/1988 | Foulard et al. | 266/207 |
| 4,915,362 A | | 4/1990 | Borasci et al. | |
| 5,196,072 A | | 3/1993 | Bermel et al. | |
| 5,230,439 A | * | 7/1993 | Klok et al. | 220/420 |
| 5,343,491 A | | 8/1994 | Herren et al. | |
| 5,458,671 A | | 10/1995 | Butler et al. | |
| 5,538,184 A | * | 7/1996 | Karbanowicz et al. | 239/14.2 |
| 5,683,652 A | | 11/1997 | Fünders et al. | 266/45 |

OTHER PUBLICATIONS

"Fume Suppression in the Iron, Steel, and Nonferrous Industry—The Alect™ Process", pp. 611–626, by Frank A. Vonesh, Jr., The Minerals, Metals & Materials Society Dec. 1993.

* cited by examiner

*Primary Examiner*—Scott Kastler
(74) *Attorney, Agent, or Firm*—Oblon, Spivak, McClelland, Maier & Neustadt, P.C.

(57) ABSTRACT

A process for reducing fume, dust and/or smoke emission in transferring molten metal, entailing:

a) blanketing molten metal, preferably steel or iron with, at least, solid carbon dioxide; and b) allowing the carbon dioxide to sublime, thereby restricting free air access to the molten metal, and reducing fume, dust and/or smoke emission therefrom.

30 Claims, 4 Drawing Sheets

PROCESS FOR REDUCING FUME EMISSIONS DURING MOLTEN METAL TRANSFER

This application is a Continuation of application Ser. No. 08/746,310, filed on Nov. 8, 1996, now abandoned, which is a continuation-in-part (CIP) application of Ser. No. 08/474,194, filed on Jun. 7, 1995 now U.S. Pat. No. 6,045,805, which is a continuation of Ser. No. 08/310,359, filed on Sep. 21, 1994 now abandoned, which is a continuation of Ser. No. 08/187,660, filed on Jan. 25, 1994 abandoned, which is a continuation of Ser. No. 07/815,578, filed on Dec. 30, 1991 abandoned, which is a continuation of Ser. No. 07/477,581, filed on Feb. 9, 1990 abandoned.

BACKGROUND OF THE INVENTION

1. Field of the Invention

The present invention relates, generally, to processes and apparati for suppressing the generation of fumes of iron oxides or nitrogen oxides, for example, wherever molten metal, such as steel or iron, is transferred in steelmaking, and, in particular, during the process known as iron beaching. The processes and apparati of the present invention may also be used in non-ferrous metal transfers.

2. Discussion of the Background

In transferring molten metal, such as ferrous metal like steel or iron, during steel production, large quantities of fumes are emitted, particularly red or brown iron oxide fumes resulting from air oxidation of the iron. Of course, the emitted fumes may run afoul of regulations either when outdoors or indoors. This problem can arise in a variety of instances during the production of steel.

For example, molten crude iron or ferromanganese is currently introduced into a casting bed when tapping a blast furnace, in open air, that is, free air access to the molten material is permitted. However, free air access causes several problems. The atmospheric oxygen oxidizes the crude iron or ferromanganese and the resultant oxides rise as pollutants or dust and pollute the surrounding air. In addition, some of the carbon released from crude iron during cooling burns off in atmospheric oxygen resulting in additional emissions.

In order to meet mandated environmental pollution regulations, expensive and energy-intensive dust reduction operations must be performed in casting houses. The high speed air blasts required by these operations cause extensive cooling of the crude iron. This results in a permanent thermodynamic supersaturation of the crude iron with carbon which lead to additional dust emission.

The high air blast speeds and resultant increase in available oxygen causes the carbon in the refractory material in the tapping region to oxidize more quickly, resulting in premature wear. Similarly, the crude iron and ferromanganese are also further oxidized resulting in additional dust pollutants that must be extracted.

Liquid nitrogen has been used in the region of the tapping runner in an attempt to reduce iron oxide pollution by preventing free-air access. However, liquid nitrogen is extremely cold, thus, requiring additional and expensive safety measures for storage and handling. Further, undesired nitriding of the crude iron may reduce the quality of the steel produced.

Fume emission remains problematic wherever molten steel or iron is transferred in steelmaking processes, regardless, of whether it be from container to container or from container to ground or a pit, whether indoors or outdoors. Notably, when iron beaching operations are performed indoors, it is usually necessary to evacuate all mill personnel due to the large amount of red or brown iron oxide fumes produced. Of course, when such operations are effected outside, the iron oxide fumes escape into the atmosphere unabated.

Emissions of a similar nature are present during non-ferrous molten metal transfers, for example, in production of aluminum and copper.

Thus, a need exists, generally, for a method of transferring molten steel, iron or other metals which avoids the above drawbacks. In particular, a need exists for a method of beaching iron which avoids these drawbacks.

SUMMARY OF THE INVENTION

Accordingly, it is an object of the present invention to provide a process for transferring molten steel, iron or other metals with reduced fume, dust and/or smoke emissions.

It is also an object of the present invention to provide a means for meeting increasingly strict environmental requirements for emissions stemming from the production of steel and metals generally.

It is, moreover, an object of the present invention to provide an operable carbon dioxide fume suppression system for the ferrous and non-ferrous metals industry.

Accordingly, the above objects and others are provided, in part, by a process for transferring molten metal with reduced fume, dust and/or smoke emission, which entails blanketing the molten metal with, at least, solid carbon dioxide, and allowing the solid carbon dioxide to sublime, thereby restricting free air access to the molten metal, and reducing fume, dust and/or smoke emission therefrom.

DETAILED DESCRIPTION OF THE PREFERRED EMBODIMENTS

Figure 1A:
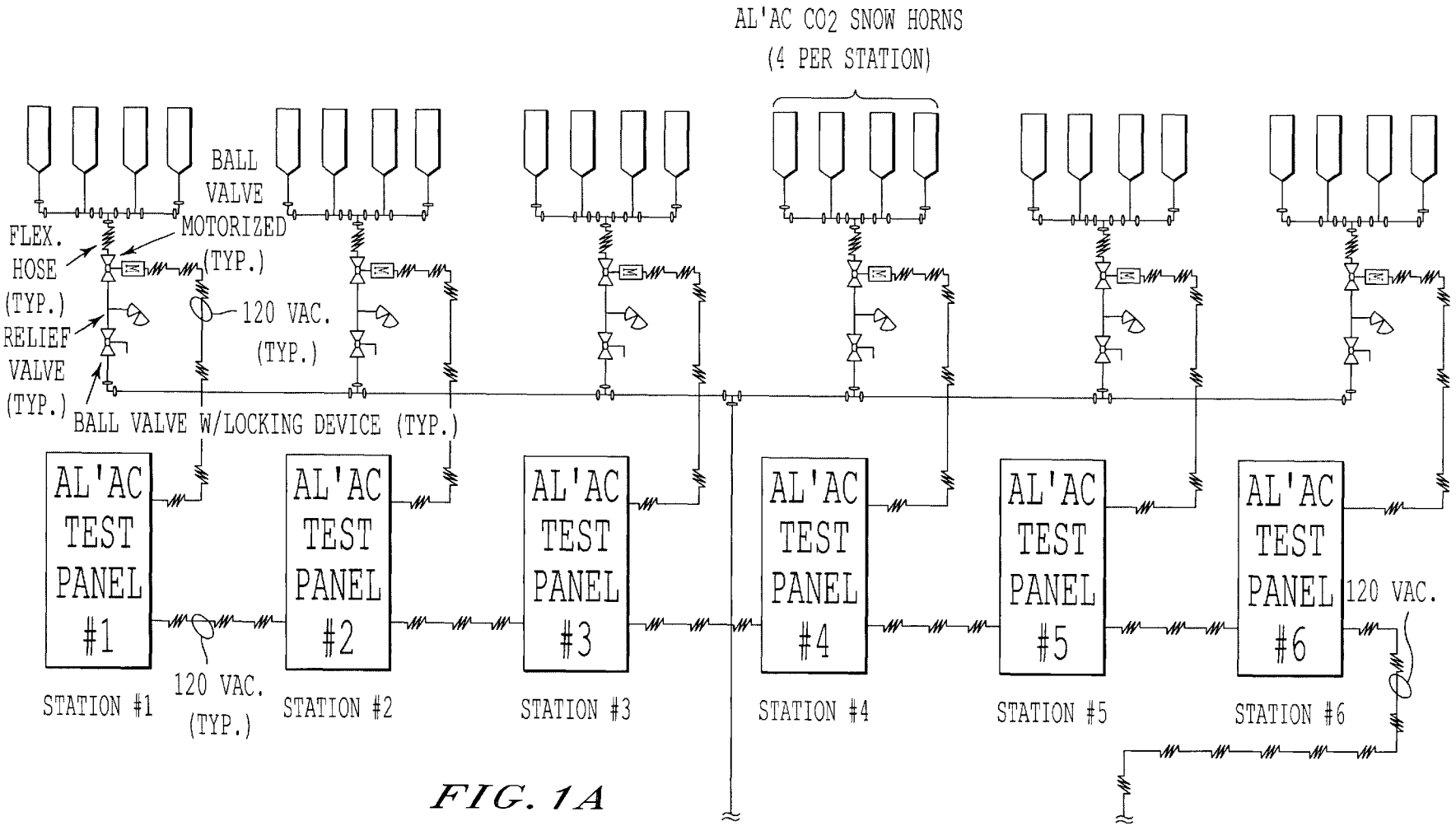
FIG. 1 illustrates an overall schematic of a fume suppression system of the present invention.

In accordance with the present invention, a means is now provided for reducing dust and pollutant emission during the transfer of molten metals, particularly steel or iron in steelmaking processes, without introducing additional atmospheric nitrogen and oxygen into the molten metal and with or without using protective hoods. Carbon dioxide in solid state, either in the form of snow (flakes) or pellets, is applied in the vicinity (i.e. over, under and/or around) of the molten material. In one aspect of the present invention, the solid carbon dioxide is applied to a molten metal to prevent air access in the region of the tapping runner, the downstream rocking runner, the torpedo ladle and/or at least a portion of a casting bed, for example. The solid carbon dioxide may be applied directly on top of and/or below the molten material and/or to these runners and vessels before and/or during contact with the molten material.

A convenient technique for applying the carbon dioxide in a solid state in accordance with this aspect of the present invention, entails, for example, the use of one or more carbon dioxide snow horns or cannons for charging the tapping region with carbon dioxide. The carbon dioxide may be applied to the tapping region at the time of, or just before, the application of the molten metal. In particular, it may be convenient to charge the system with carbon dioxide in the same sequence as the molten metal. That is, the carbon dioxide is applied to the tapping region in the following sequence: the tapping runner, rocking runner, torpedo ladle and/or the casting bed.

In the region of the tapping runner or runners, for example, including both iron or slag runners, the carbon dioxide may be applied in a solid, or even, if desired, in a combined solid and gaseous mixture, by means of a special snow cannon, both directly on the tapping side and at several points along the runner. The carbon dioxide snow floats on the molten material up to the entrance to the rocking runner. As the carbon dioxide snow sublimes, additional carbon dioxide gas is continually released into the atmosphere reducing the partial pressures of atmospheric oxygen and nitrogen. The exclusion of air can readily be controlled and adjusted in accordance with the conditions at the time by the use of varying amounts of carbon dioxide snow.

The carbon dioxide snow of the present invention is similar to water-ice snow at a temperature of about —110° F. Further, solid carbon dioxide sublimes to carbon dioxide gas at 8.5 $ft^3$/lb. at STP. Generally, in accordance with the present invention, solid carbon dioxide is preferable to gaseous carbon dioxide in application as the former has a lesser cooling effect on the overall system heat.

In the region of the rocking runner, the surface area of the molten material is increased many times as the material is transferred from the tapping runner to the rocking runner by the casting jet. The surface area also increases substantially as the molten material is transferred from the rocking runner to the torpedo ladle. In conventional processes, these increases in surface area lead to a substantial intensification of undesired oxidation, dust and pollution emissions and nitriding of the molten material. In accordance with the present invention, however, gaseous carbon dioxide displaces atmospheric oxygen and nitrogen as the carbon dioxide snow is applied simultaneously to both the molten material within the rocking runner and to the casting jet from the crude iron runner to the rocking runner, for example.

The flow of molten material from the casting jet into the torpedo ladle causes intense turbulence associated with the very large increase in surface area of the molten material with results similar to those noted above. By replacing the entire atmosphere within the torpedo ladle with carbon dioxide, it is possible to substantially reduce or even eliminate oxidation and nitriding. In addition to applying carbon dioxide to the surface of the molten material, it is also advantageous to apply carbon dioxide snow as a bottom layer of the ladle to provide a reservoir of carbon dioxide for the duration of a tap and ensure that the atmosphere therein is substantially depleted of oxygen and nitrogen.

The flow of molten material in the pouring region from the torpedo ladle to the casting bed also results in the intense turbulence phenomena noted above. This region is usually located in open air without any convenient pollution control mechanisms and generates substantial dust emissions. Stricter environmental restrictions are expected for this type of molten metal transfer in the future. The combined use of carbon dioxide snow and gas, especially if both the casting chamber and the casting bed are protected thereby from free air access, can provide substantial improvement in the reduction of pollution by fume, dust and/or smoke emission.

In accordance with the present invention, the expenses associated with conventional dust and fume reduction operations, such as baghouses, may be substantially reduced or even eliminated. The same result is true for other mandated pollution reduction expenses. Similarly, the energy costs associated with such operations as well the investments for structures, such as casing buildings, and the like can be dramatically reduced. Expenses involved in configuring a system for use with the present invention, such as the partial fitting of extraction hoods, is relatively small when compared with the costs associated with conventional fume, dust and/or smoke reduction operations and/or conventional measures for reducing or preventing oxidation and/or undesired nitriding of the product.

As noted above, the use of carbon dioxide in accordance with the present invention substantially reduces not only the fume, dust and/or smoke emissions associated with the tapping region of a blast furnace but also the nitriding of the molten material and the addition wear of refractory material. The substantial reductions in down time for relining and repair dramatically reduces costs and extends service life and capacity.

In a second, and more particular aspect, the present invention provides a carbon dioxide fume suppression system having one or more stations. This system may be widely used in molten metal transfers in modern iron or steel-making or non-ferrous metal production, such as production of aluminum, magnesium or copper. An example of this system may be seen in FIG. 1.

Figure 1B:
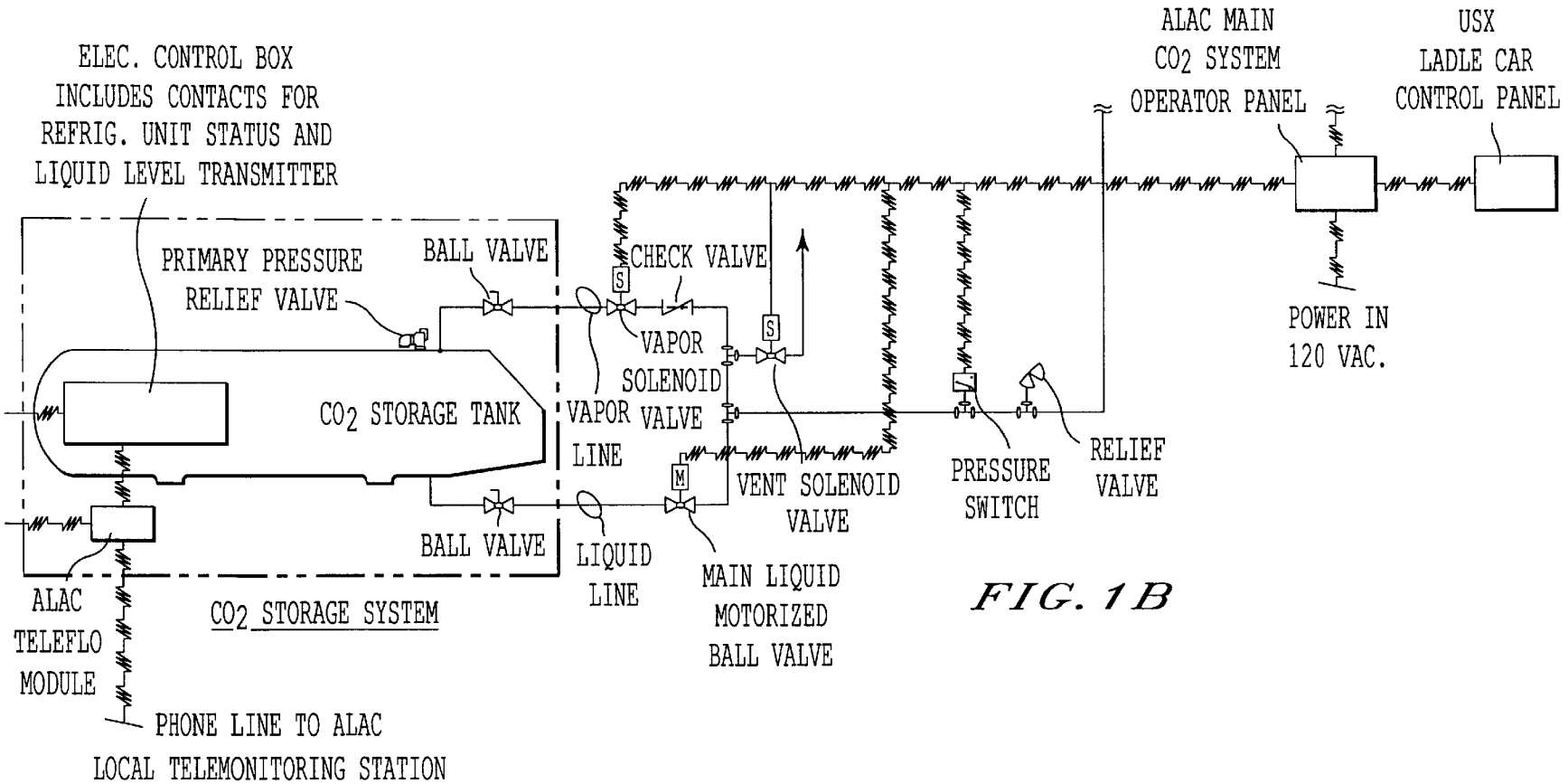

In detail, FIG. 1, illustrates a fume suppression system having six stations, each having four snow horns. Each station has a corresponding test panel which, in turn, is in electrical communication with a main operator panel. Each station is fed from a carbon dioxide storage tank which is in electrical communication with telemonitoring means for monitoring liquid level and refrigeration status. From FIG. 1, it is seen that the system also includes various ball and check valves, pressure and relief switches as well as vapor solenoid and vent solenoid valves.

This system utilizes a process wherein carbon dioxide, either alone or in admixture with other non-oxidizing gases such as argon, is used as an inert gas to blanket the molten metal from exposure to oxygen and nitrogen in the atmosphere. This inhibits the formation of iron oxide which is the reddish-brown or orange fume typically created in the transfer of molten iron or steel, such as is observed when beaching torpedo ladle cars.

Figure 2:
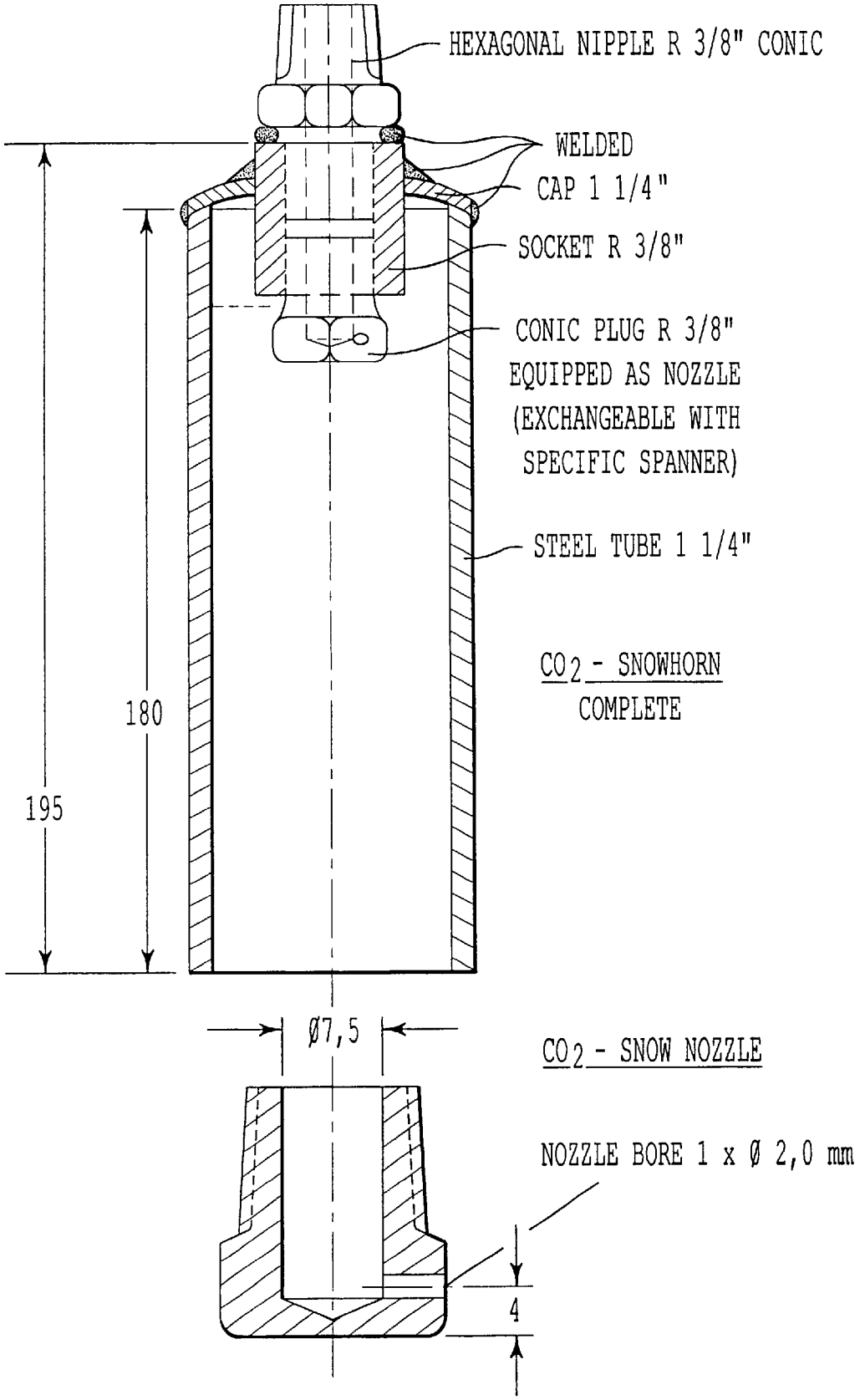
FIG. 2 illustrates a snow horn or cannon of the present invention for iron beaching.

In accordance with this aspect of the present invention, carbon dioxide is transported from a bulk liquid storage tank or cylinders to the area of application in a refrigerated liquid state about, at pressures ranging from about 200 to 300 psig. The liquid carbon dioxide is subjected to a pressure drop down to atmospheric pressure through a flow restricting discharge nozzle on the end of the snow horn or cannon to allow a specific amount of liquid carbon dioxide flow. The liquid carbon dioxide initially converts to a solid dry ice and cold gas mixture at about —110° F. inside the horn or cannon. The horn is especially designed to focus the trajectory of the solid carbon dioxide snow to the application point. Different horn or cannon designs, including different length to diameter ratios, in combination with different nozzle sizes can provide a stream of snow with greater or lesser "thrust", to suit the intended application. An example of a snow horn or cannon of the present invention and a housing therefor are depicted in FIGS. 2 and 3, respectively. U.S. Pat. No. 4,911,362 is herein incorporated by reference in the entirety.

FIG. 2 illustrates an exemplary snow horn of the present invention. Notably, the snow horn contains a snow nozzle inside of a socket and conic plug as shown. The particular snow horn shown in FIG. 2 has a hexagonal nipple R ⅜ conic, welded cap 1 ¼, socket R ⅜ and conic plug R ⅜.

Figure 3A:
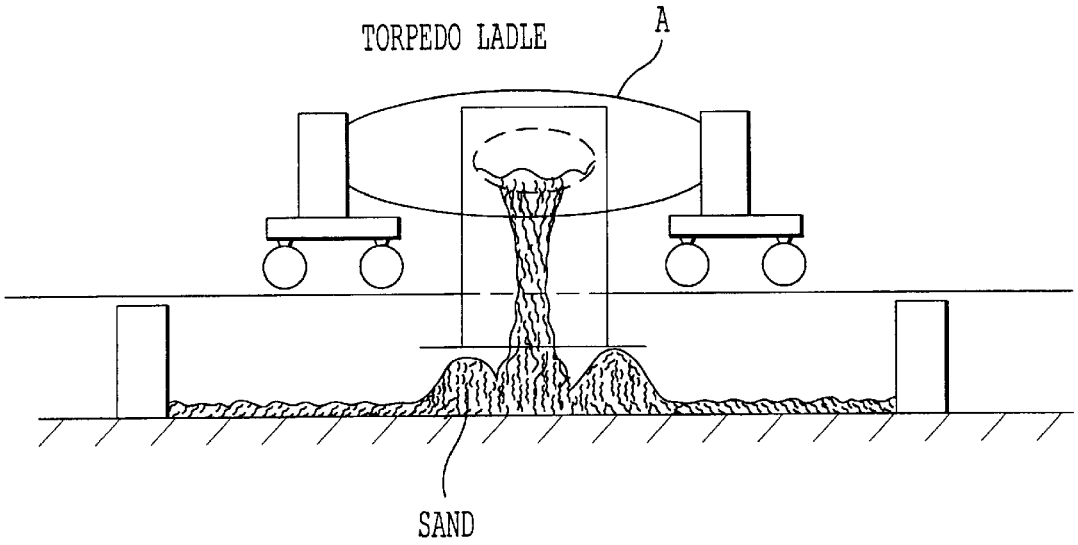
FIGS. 3*a* and 3*b* illustrates a snow cannon housing for iron beaching in accordance with the present invention with 3*a*) showing a side view and 3*b*) showing a front or rear view.
Figure 3B:
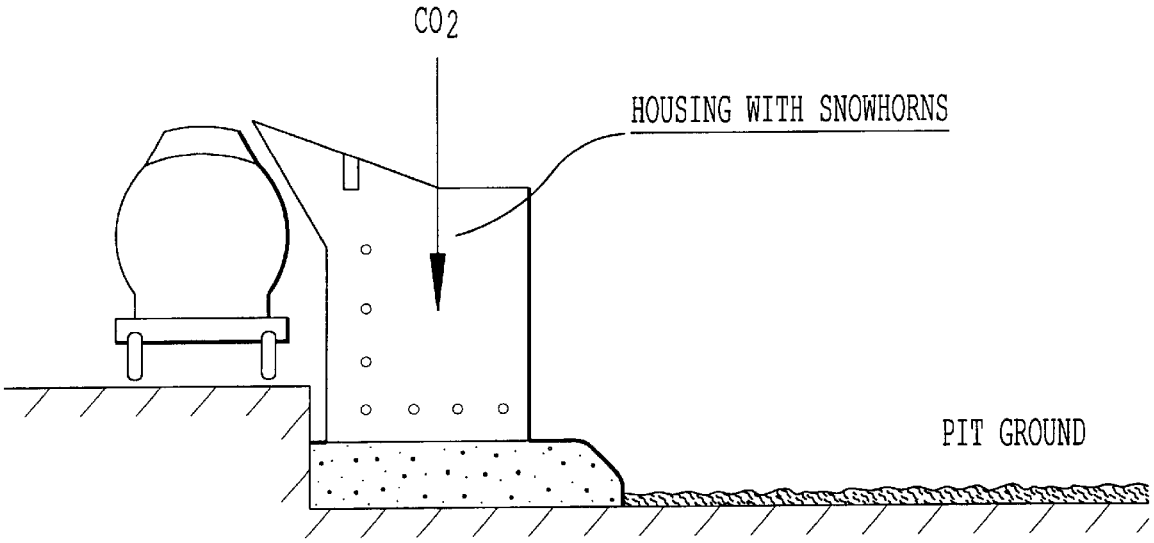

FIG. 3 illustrates an exemplary snow horn housing of the present invention. Specifically, FIG. 3*a* illustrates a side view of a torpedo ladle at the housing with snow horns, whereas FIG. 3*b* illustrates with a front or rear view of the same.

Indeed, an important aspect of the present invention entails the use of properly designed snow horns, cannon or devices to increase the effectiveness of carbon dioxide in inerting and blanketing applications, by taking advantage of the density of solid snow so that it can be carried to the desired application point, and by also taking advantage of the tremendous solid-to-gas sublimation expansion factor to facilitate purging atmospheric oxygen from the area. Thereby, an inert environment is provided to protect molten metal from oxidation, and, hence, reduce formation of the ambiguously observed reddish-brown fume in the case of iron or steel.

As noted above, carbon dioxide gas has a density of about 8.5 $ft^3$/lb at STP, or about 0.11 lb/$ft.^3$. Solid carbon dioxide snow has a density of about 20 to 30 lbs/$ft.^3$ after settling.

Further, in accordance with the present invention, the snow horns or devices have a length to diameter ratio in the range of about 1.5:1 to 3:1.

Additionally, the number of snow horns and size of the discharge nozzles may vary in accordance with the overall objective of blanketing the top and sides of the molten metal.

By carefully positioning the horns or devices to effect a preferred distribution of snow relative to the molten iron stream flow path, it is possible to increase utilization effectiveness.

During beaching of torpedo ladle cars, for example, considerable iron oxide fume is typically generated, in many cases causing high emissions often in violation of environment regulations.

In tests conducted using the present invention in conjunction with iron beaching, a significant reduction in visible fume was observed. The reduction in visible emissions can greatly assist steelmaking facilities in remaining in compliance with ever-tightening environmental air quality regulations. In this regard, the present system presents a viable alternative to a more capital and labor intensive dust capturing system, which would typically involve an overhead canopy, baghouse, fan, and interconnecting ductwork with dampers and controls. Advantageously, this more complicated methodology may now be avoided.

In addition to significantly reducing visible emissions, the present system also dramatically reduces the time required for the beaching building air quality analyzers ($CO,SO_2$) to indicate "all clear" after the dump. This reduction in ambient air "clearout" time allows personnel to enter the building more quickly after a ladle dump. This allows for a reduction in ladle turnaround time and, hence, improves overall productivity.

The present invention also provides a carbon dioxide storage system which may include an automated telemonitoring system for continuous remote monitoring of liquid carbon dioxide level and refrigeration unit status, however, any conventional tank monitoring system may be used.

In an advantageous embodiment, the system may be advantageously connected via a telephone line to a local monitoring station whereby liquid carbon dioxide level in the vessel and refrigeration unit status may be monitored daily or even more frequently as deemed necessary.

Liquid level in the vessel may be measured continuously by an electronic liquid level transmitter. If the liquid level falls below a prescribed lower limit, notification may be made automatically via the telemonitoring system. Refrigeration unit status is determined by tank pressure; likewise, if tank pressure rises above the normal prescribed operating range, indicating that the refrigeration unit has malfunctioned, notification may be made via the telemonitoring station.

In particular, the system of the present invention significantly reduces visible fumes given off during the beaching of iron torpedo car ladles. Upon sublimination of the carbon dioxide snow from solid to gas, a tremendous expansion occurs which causes a purging effect in the immediate area of the iron or steel. This reduces the oxygen concentration in the surrounding area, which protects the molten iron or steel from oxidation, hence, reducing the formation of the typically observed reddish-brown or orange iron oxide dust plume.

An example of the system of the present invention for iron beaching will now be described in more detail. This example is merely illustrative and not intended to be limitative.

Carbon Dioxide Snow Horns

An adequate number of carbon dioxide snow horns or cannons are provided for each station. Each carbon dioxide snow horn includes a liquid carbon dioxide discharge nozzle. Liquid carbon dioxide, at a supply pressure of about 200 to 300 psig, is discharged through the nozzle into the horn. The snow horns are specially designed to facilitate formation of solid carbon dioxide snow, and to focus the trajectory of the snow to the application point. Specifically, it is important to project the snow with sufficient velocity to overcome air flow caused by hot metal. This improves the utilization efficiency of the carbon dioxide in inerting applications, by taking advantage of the density of solid snow so that it can be carried to the application point, and by also taking advantage of the extremely large solid-to-gas sublimation expansion factor. Notably, the carbon dioxide snow is carried by cold gas and not by itself.

Within each iron beaching station, different horn sizes in combination with various discharge nozzle sizes are used in order to maximize efficiency and the flowrate and trajectory of carbon dioxide snow at each distribution point. A total of 2 different horn sizes and 3 different discharge nozzle sizes are typically implemented.

Preferably, hoods are installed at each station over the pouring area in front of each car. The hoods help contain emitted fumes and carbon dioxide, cut down on "chimney effect" air infiltration into the pouring area which is a source of oxygen for iron oxidation, and provide a framework for mounting the snow horns. The mounting position of each horn within the mounting hoods is adjusted so that carbon dioxide snow is distributed in desired areas relative to the molten iron stream being poured from the ladle car.

Generally, more carbon dioxide snow is required when hoods, shrouds or baffles are not used. Notably, a large air aspiration causes the snow to sublime to gas before it reaches the area of the molten metal. Thus, while the mounting position of each snow horn or cannon within the mounting hoods is generally adjusted so that carbon dioxide snow is distributed in areas to where the molten metal stream is being poured from the ladle car, the horns or cannons are mounted primarily in areas where air would be drawn into contact with the molten metal stream.

Carbon Dioxide Storage Tanks

The present system may utilize one or more commercially available bulk carbon dioxide storage tanks. Typical sizes range from about 6 to 100 tons.

A commercial bulk carbon dioxide storage tank which is preferred in accordance with the present invention is an ASME coded pressure vessel rated for an approximately 350 psig working pressure, and insulated to reduce heat input. A mechanical refrigerator unit may be used to recondense vaporized liquid. Additionally, a pressure building vaporizer may be required to maintain a uniform storage pressure and compensate for the pressure decrease caused by carbon dioxide withdrawal.

BEACH IRON HOUSING SYSTEM

When designing the housing for the dumping or beaching of molten iron from a torpedo car, the housing should preferably snugly house the torpedo. Thus may be seen in FIGS. 3*a* and 3*b*. Notably, it is the volume of carbon dioxide that creates the requisite pressure and pushes air out. Thus, there is preferably no room for air to ingress into the housing and reach the metal. Also, it is preferred that the opening of the torpedo car be completely covered. Inside of the housing are, for example, a plurality of snow horns, which are well placed as described above. Any number or size of horns may be used as needed. The specifics of the snow horns are shown on the following schematic.

carbon dioxide Supply: 30 ton bulk tank.
- 180' (55 m) insulated copper tubing Ø (diameter symbol)
- 1' (25 mm) with a pop valve 290 psi (20 bar).
- 33' (10 m) high pressure hose Ø 1" (25 mm)

Housing: Sheet metal, inside refractory with 24 carbon dioxide snow horns.
- length=7.8' (2.4 m)
- width=7.2' (2.2 m)
- length=13.8' (4.2 m)/10.8' (3.3 m)

Snow Horns: below molten metal stream—11 each, nozzle with
- 1 hole Ø 0.0788" (2.0 mm)
- above molten metal stream—3 each, nozzle with 1 hole Ø 0.059" (1.5 mm)
- lateral respective 5 each, nozzle with 1 hole Ø 0.059" (1.5 mm)

Carbon Dioxide Flow Rate: 150 lbs/min (75 kg/min)

Carbon Dioxide Pressure: 200 to 300 psig (15 bar)

Torpedo Capacity: 220 tons hot metal normally 150–170 tons hot metal

Pouring Speed: Without the present system, 5 tons hot metal/minute With the present system, 15 tons hot metal/minute Specific Consumption: 10 lbs carbon dioxide (5 kg)/ton hot metal Advantages:—Fume suppression 90%–95%
- Increased pouring speed
- Possibility of governmental environmental credits Control System A control system, consisting of a set of valves and other required major components, along with a main operator control panel plus individual station test panels, is included in the equipment package. Through the operator control panel, the operator can energize the system, pressurize the system piping, discharge carbon dioxide to the selected station, automatically purge the system piping of liquid carbon dioxide when complete, and depressurize the system. Notably, liquid carbon dioxide forms dry ice that can block piping if the pressure falls below the triple point (60 psig, −70° F.). Thus, it is necessary to pre-purge and post-purge piping with vapor to present blockage. The operator control panel may be tied in with the existing facility control panel for movement of ladle cars so that car movement and carbon dioxide discharge is properly coordinated.

The system is, of course, designed and manufactured to comply with applicable codes and standards and, in particular, with OSHA 1910-147 lockout/tagout energy control procedures for U.S. installations.

Exemplary Sequence of Operation

1) Hood(s) are placed into position at desired station(s). Limit switch interlock requires hood to be in position before carbon dioxide discharge is allowed at any given station.

2) Ladle car(s) are set in position at each hood. Activate power to (each) ladle car. Relay interlock requires (tilt motor) power to be activated at any given ladle car before carbon dioxide discharge is allowed at dW station.

3) Carbon dioxide system control panel is energized (main on-off lever). Panel "test bypass" selector switch is turned to the off position.

4) Carbon dioxide system piping is pressurized.

5) Station to be tilted with facility selector switch is selected.

6) Relay interlock allows carbon dioxide discharge only at station selected for tilting in step 5 above. Carbon dioxide discharge is allowed at only one station at a time.

7) At operator panel, carbon dioxide discharge is turned on at desired station. Through relay interlock, car cannot be tilted forward at the selected station unless carbon dioxide discharge at that station has been turned on. Note: backward ladle car tilt is allowed regardless of carbon dioxide discharge status.

8) Wait for visible carbon dioxide snow at selected station, then begin pour. Carbon dioxide discharge rate is preferably constant throughout the pouring process.

9) When pour is complete, at panel turn carbon dioxide discharge off at the selected station. The system may be adjusted to automatically purge piping of liquid carbon dioxide through this station. This will require about 1 minute. Carbon dioxide cannot be discharged at any other station until this purge cycle has completed; consequently, a second ladle car preferably cannot be tilted forward until this carbon dioxide purge cycle for the first station has completed and carbon dioxide to the second station has been initiated.

10) Empty ladle car is tilted back to desired position.

11) For multiple ladle cars in sequence, repeat steps 5–10.

12) After all ladle cars have been dumped, carbon dioxide system is depressurized at operator panel. Proceed with normal facility procedures for removing empty ladle cars from building, or from beaching area if no building.

Notably, after a discharge of carbon dioxide, as long as the panels along the bottom of the beaching building walls and the roof panels all remain open to allow ventilation through the building, ambient carbon dioxide concentration levels inside the building workspace should be reduced to safe levels within the same time required for the other currently monitored species ($CO$, $SO_2$) to be reduced to safe levels.

The "test bypass" selector switch on the main operator panel allows testing or demonstrating the system without a "live" pour. After first moving the hood(s) into position, and then energizing and pressurizing the system from the main operator panel and selecting "test bypass on", the individual station test panels can then be used to discharge carbon dioxide snow to each individual station (one station at a time only). When each station test panel is turned off, liquid carbon dioxide is automatically purged, as in step 9 above.

Major Components of the Multi-Station System

The major system components of an exemplary multi-station system are listed below and may be understood in conjunction with FIG. 1. It is noted, however, that the system described below is merely exemplary and not intended to be limitative.

- 24 snow horns (4 per station) with discharge nozzles. Horn and discharge nozzle combinations will be sized accordingly; there will be a total of 2 different horn sizes and 3 different discharge nozzle sizes.
- 6 motorized ball valves with spring return (1 per station)
- 6 locking ball valves (1 per station) for station isolation
- 6 pressure relief valves (1 per station)
- 6 stainless steel flex hoses (1 per station)
- 1 main header pressure relief valve
- 1 pressure switch
- 1 main liquid supply motorized ball valve with spring return
- 1 vapor purge solenoid valve
- 1 vent solenoid valve
- 1 in-line vapor check valve
- pressure gauges as required
- stainer(s) as required
- one main operator control panel, in stainless steel cabinet includes pre-wired and pre-assembled pushbuttons, selectors switches, indicator lights, relays and other components as required
- six individual station test panels, pre-wired and pre-assembled (each includes selector switches, and other components as required).

outside of the dashed indicating line shown on the attached system schematic diagram, interconnecting piping and minor piping components such as tees, elbows, and fittings are not included.

The carbon dioxide storage system of the present invention also may include a system for telemonitoring of liquid level and refrigeration unit status.

As noted above, the aforementioned fume suppression system is merely one example of the system of the present invention and many variations therefrom are contemplated within the scope of this invention.

For example, while torpedo ladle cars of about 200 to 250 tons capacity are often used, any capacity may be used. Further, any number and size of carbon dioxide snow horns may be employed. For example, if torpedo ladle cars of reduced capacity (relative to 200–250 tons) are used, fewer carbon dioxide snow horns might be used, such as from 1 to 3 per station, for a total of 6 to 18 for 6 stations. Conversely, if torpedo ladle cars of enhanced capacity (relative to 200–250 tons) are used more carbon dioxide snow horns might be used, such as from 5 to 8 per station, for a total of 30 to 48 for 6 stations.

The present system may be used in many applications in steel and other metals production, from oxygen lancing to molten metal transfer. For example, in molten metal transfers above, the following applications may be noted: blast furnace tapping, beach iron dumping, re-ladling, mixer tapping, BOF tapping and EAF tapping. Further, in metal slag or scrap cutting, the following applications may be noted: slag button lancing; continuous caster tundish lancing; ladle slide gate lancing; scrap, billet, and revert cutting; and carbon powder injection. However, the present invention is preferably used in iron beaching operations.

In non-ferrous metals production, the processes and systems of the present invention may be used to advantage. For example, in production of copper, sulfur in copper is liberated as sulfur dioxide if the molten copper is transferred through air. The present invention may be used to great advantage in alleviating such problems.

More specifically, cryogenic carbon dioxide is transformed in solid carbon dioxide snow when exposed to a pressure drop of from at lest about 200 psig, preferably at least about 250 psig, more preferably about at least 280 psig to atmospheric pressure. The carbon dioxide snow is directed in a transfer vessel to purge out all atmospheric gases, such as nitrogen and oxygen. As the carbon dioxide snow sublimates it expands, thereby creating a positive pressure inside the transfer vessel. With the removal of atmospheric gases, gas pick-up and fume generation are dramatically reduced.

The present invention will now be further described by reference to certain examples, which are provided solely for purposes of illustration and are not intended to be limitative.

EXAMPLE 1

Blast Furnace Fume Suppression

1. Experimental Set-up 1.1 Carbon Dioxide-Supply

- by 11 to road tanker 1.2 Snowhorn Supply with Carbon Dioxide

- for transfer ladle snowhorn 0.75 mm, 4.5 m long, nozzle 1×07.0 mantel operated, with ball valve DN 15
- for tilting channel (housing) 1 snowhorn 0.75 mm, 2.45 m long 1×4.0 mm mantel operated, with ball valve DN 15
- power of both snowhorns at 18 bar tank pressure=50 kg carbon dioxide/min 1.3 Connection: Road Tanker/Snowhorns

- 10 m high-pressure hose DN 25 with security valve 25 bar
- Y-connection ¾"–1"¾"
- 10 m high-pressure hose DN 20 from snowhorn to transfer ladle
- 5 m high-pressure hose DN 20 from snowhorn to tilting channel

2. Execution of the Trial

- inertisation of the empty ladle was effected before each change of the ladles during 20–30 seconds
- then carbon dioxide was supplied during whole running period of pig iron
- carbon dioxide was applied during two run-offs
- The total time of carbon dioxide inertisation was 3 hours and 18 minutes. For all trials the consumption was 9620 kg carbon dioxide.

3. Evaluation

- Fume suppression was impressive.
- Fume development is not a determined size. Even during one run-off and under apparently same conditions changes can be measured
- Due to carbon dioxide regulation which is adapted to the fume development, the specific high consumption of 10 kg carbon dioxide/to pig iron was considerably reduced.
- The measured carbon dioxide content which is intensified directly near the housing, was reduced by a defined stack effect to the maximum working place concentration (30 ppm).

EXAMPLE 2

Hot Metal Transfer—Torpedo Ladle into Pouring Pit—Fume Suppression at Pouring Pit carbon dioxide-Supply: 30 to-bulk
55 insulated copper-tubes 32 mm with safety valve 20 bar
10 m high-pressure-hose 25 mm Housing: sheet-metal, inside refractory with 24 carbon dioxide snowhorns
length=2.40 m
width=2.20 m
height=4.20 m/3,30 m Snowhorns: below metal: 11 each with nozzle 1×2.0 mm
above metal: 3 each with nozzle 1×1.5 mm
lateral to metal: 5 each with 1×1.5 mm carbon dioxide-flow rate: 75 kg/min.

carbon dioxide-working pressure: 15 bar

Torpedo capacity: 220 to hot metal normally: 150–170 to hm

Pouring speed: without carbon dioxide 5 to hot metal/min.
with carbon dioxide 15 to hot metal/min.

Specific consumption: 5 kg carbon dioxide/to hot metal

Results: —fume suppression of 90–95% was obtained; and an
increase of pouring speed was thereby, made possible.

EXAMPLE 3

Fume Suppression During Beaching of Iron

The objective of this experiment was to reduce airborne emissions and iron oxide fumes during beaching of iron.

A carbon dioxide cannon was placed under a torpedo car aimed at a molten metal stream.

Fume suppression of greater than 90% was noted. It was also noted that carbon dioxide worked surprisingly better than an additional fume capture hood.

In accordance with a preferred aspect of the present invention, the present invention is used for fume suppression, using either pure carbon dioxide or carbon dioxide in admixture with other inert gases, during iron beaching operations in a steel mill. In iron beaching, the present invention affords a reduction of fume of greater than 90%. Further, the present multi-station system, affords a dramatically reduced required time for beaching building air quality analyzers (Co, $SO_2$) to indicate "all clear" after the dump. This reduces ladle turnaround time and improves overall productivity.

The present invention, thus, generally provides fume reduction of 90% or more, reduced dust generation, reduced pick-up of oxygen and nitrogen, increased operator visibility, reduced dust load to baghouse and a cleaner, safer working environment.

Having described the present invention, it will be apparent to the artisan that many changes and modifications may be made to the above-described embodiments without departing for the spirit and scope of the present invention.

What is claimed as new and desired to be secured by Letters Patent of the United States is:

1. A process for reducing fume, dust or smoke emissions or a combination thereof in transferring molten metal, comprising:

a) blanketing molten metal with a cryogen containing, at least, solid carbon dioxide which is in the form of snow or pellets; and b) allowing said solid carbon dioxide to sublime, thereby restricting free air access to the molten metal, and reducing fume, dust or smoke emission, or a combination thereof therefrom;

wherein said carbon dioxide snow or pellets is provided from carbon dioxide storage means equipped with telemonitoring means to continuously measure liquid carbon dioxide level and refrigeration.

2. An apparatus for reducing fume, smoke or smoke emission or a combination thereof during beaching of iron or steel, which comprises:

carbon dioxide storage means in fluid connection with at least one beaching station, said beaching station having at least one snow horn or cannon for delivering carbon dioxide snow or pellets to beached iron;

wherein said carbon dioxide storage means is equipped with telemonitoring means to continuously measure liquid carbon dioxide level and refrigeration.

3. An apparatus for reducing fume or smoke or both during transfer of non-ferrous molten metal, which comprises carbon dioxide storage means in fluid connection with at least one station, said station having a plurality of snow horns or cannons or delivering carbon dioxide snow or pellets to a vicinity of the non-ferrous molten metal, wherein said carbon dioxide storage means is equipped with telemonitoring means to continuously measure liquid carbon dioxide level and refrigeration.

4. The process of claim 1, wherein the carbon dioxide snow is applied from a plurality of snow horns or cannons, with at least one snow horn or cannon per station.

5. The process of claim 1, wherein the carbon dioxide is applied to either the top or the bottom of the molten metal or both or on runners.

6. The process of claim 1, wherein said carbon dioxide snow is applied during blast furnace tapping, iron beaching, re-lading, mixer tapping, BOF tapping, EAF tapping, furnace charging or transfer of non-ferrous molten metal.

7. The process of claim 6, wherein said non-ferrous metal is selected from the group consisting of aluminum, magnesium and copper.

8. The process of claim 6, wherein said carbon dioxide snow is applied to torpedo ladle cars during iron beaching.

9. The process of claim 4, wherein from about one to eight snow horns are provided at each of a plurality of beaching stations.

10. The process of claim 8, wherein four carbon dioxide snow horns are provided at each of six beaching stations.

11. The process of claim 1, wherein fume emissions are reduced by at least 90% as measured by opacity.

12. The apparatus of claim 2, having a plurality of beaching stations.

13. The apparatus of claim 12, having a plurality of snow horns at each station.

14. The apparatus of claim 2, wherein said carbon dioxide storage means has vapor and liquid conduits in connection with said station.

15. The apparatus of claim 2, further comprising an operator means in connection with said carbon dioxide storage means via check valve means and being in connection with a ladle car control means.

16. The apparatus of claim 2, wherein pressure in said carbon dioxide storage means is maintained by a pressure building carbon dioxide vaporizer.

17. The apparatus of claim 2, having from two to eight beaching stations.

18. The apparatus of claim 17, having six beaching stations.

19. The apparatus of claim 2, having four carbon dioxide snow horns per beaching stations.

20. The apparatus of claim 2, wherein said at least one snow horn contains a snow nozzle therein.

21. The apparatus of claim 2, wherein said at least one snow horn has a length to diameter ratio in the range of about 1.5:1 to 3:1.

22. The apparatus of claim 3, which has a plurality of stations.

23. The process of claim 1, wherein a major portion of said cryogen is solid carbon dioxide in the form of snow or pellets.

24. The process of claim 1, wherein said cryogen further contains argon.

25. The process of claim 1, wherein said telemonitoring means is automated.

26. The process of claim 1, wherein said telemonitoring means is operably connected to facility control panel means, thereby coordinating ladle car movement and discharge of solid carbon dioxide to said molten metal.

27. The apparatus of claim 2, wherein said telemonitoring means is automated.

28. The apparatus of claim 2, wherein said telemonitoring means is operably connected to facility control panel means, thereby coordinating ladle car movement and discharge of solid carbon dioxide to said molten metal.

29. The apparatus of claim 3, wherein said telemonitoring means is automated.

30. The apparatus of claim 3, wherein said telemonitoring means is operably connected to facility control panel means, thereby coordinating ladle car movement and discharge of solid carbon dioxide to said molten metal.

* * * * *